United States Patent [19]

Gidge

[11] Patent Number: 4,867,825

[45] Date of Patent: Sep. 19, 1989

[54] MACHINE AND PROCESS FOR FORMING CROSSWISE FILAMENTS FOR NON-WOVEN FABRIC AND PRODUCT OF THE PROCESS

[75] Inventor: Lester Gidge, Nashua, N.H.

[73] Assignee: Bay Mills Limited, St. Catherines, Canada

[21] Appl. No.: 159,349

[22] Filed: Feb. 23, 1988

[51] Int. Cl.[4] ..... B32B 5/12; D04H 3/05

[52] U.S. Cl. ..... 156/181; 28/101; 28/102; 156/434; 156/439; 156/440; 156/441

[58] Field of Search ..... 156/439, 441, 180, 181, 156/177, 434, 440; 28/100, 101, 102; 66/84 A

[56] References Cited

U.S. PATENT DOCUMENTS

| | | | |
|---|---|---|---|
| 2,954,816 | 10/1960 | Havemann | 156/177 |
| 2,954,817 | 10/1960 | Havemann | 154/1.76 |
| 3,154,452 | 10/1964 | Hartbauer | 156/178 |
| 3,345,231 | 10/1967 | Gidge et al. | 156/441 |
| 3,345,232 | 10/1967 | Gidge et al. | 156/441 |
| 3,444,020 | 5/1969 | Kalwaites | 156/177 |
| 3,519,509 | 7/1970 | Gidge et al. | 156/181 |
| 3,605,220 | 9/1971 | Atwood et al. | 28/1 |
| 3,616,067 | 10/1971 | Treckmann | 156/441 |
| 3,675,285 | 7/1972 | Atwood et al. | 28/1 |
| 3,690,990 | 9/1972 | Izumi | 156/441 |
| 3,829,339 | 8/1974 | Pinette | 156/179 |
| 4,189,811 | 2/1980 | Cole | 66/84 A |
| 4,578,141 | 3/1986 | Gidge | 156/439 |

FOREIGN PATENT DOCUMENTS 0749914 7/1953 United Kingdom .

*Primary Examiner*—George F. Lesmes
*Assistant Examiner*—J. Davis
*Attorney, Agent, or Firm*—Fitzpatrick, Cella, Harper & Scinto

[57] ABSTRACT

A stand-alone machine and a process for forming crosswise filaments for non-woven fabric comprises two sets of non-traversing edge spacing pins, each set with a gripper, and a traversing set of slider pins. The sets of pins are placed close together. Crosswise filament yarns are engaged by these sets of pins. The slider pins then traverse and pull the filaments to their full length. The crosswise filaments are cut and fixed to edge elements, which preferably may including adhering the crosswise filaments to selvage filaments. The edge elements are then separated to draw the crosswise filaments to their full width. The invention provides increased speed, precision, and flexibility in making crosswise filaments for non-woven fabrics.

37 Claims, 6 Drawing Sheets

11
5
18
2
2
16
13
2
20
19
9
19
3
17
3
3
3
11
4
18
8
10
2
13
10
2
14
1
15

MACHINE AND PROCESS FOR FORMING CROSSWISE FILAMENTS FOR NON-WOVEN FABRIC AND PRODUCT OF THE PROCESS

BACKGROUND OF THE INVENTION

1. Field of the Invention

This invention comprises a machine and a process for forming crosswise filaments for non-woven fabric. It also comprises crosswise filaments and fabrics made by the process. It has particular application in making crosswise filaments which are self-supporting, as opposed to crosswise filaments which must be held in place by hooks or the like throughout manufacture of a fabric. Self-supporting crosswise filaments can be created by a stand-alone machine and fed to any one of a variety of coaters or lengthwise filament laying machines. Crosswise filaments which are not self-supporting cannot be made by a stand-alone machine but must be made as part of an integrated machine which also lays lengthwise threads.

2. Related Art

A variety of machines have been used or proposed for making non-woven fabrics, and particularly the crosswise filaments for such fabrics. Rotating arm machines such as shown in U.S. Pat. No. 4,108,708 of Gregory lay crosswise filaments into the notches of rotating helixes. As the helixes turn, the crosswise filaments are led into contact with lengthwise filaments to form a fabric. Moving chain machines, such as shown in U.S. Pat. Nos. 4,578,141 of Gidge et al. and 3,345,231 of Gidqe et al., lay crosswise filaments into hooks on chains, which lead those filaments into contact with lengthwise filaments.

The principal problem of these prior art machines and processes has been their complexity. Complexity not only makes them expensive build, but more important, it limits their speed and their ability to make fabric with crosswise filaments of uniform spacing and length. For example, to make a six foot wide fabric in a rotating arm machine, the arm must be over three feet long. In practice, even though these arms rotate at very high velocity, the machines are limited in their lineal output of fabric. Moreover, to double the number of crosswise filaments per inch, one must halve the lineal output of fabric from the machine. In moving chain machines, such as shown in U.S. Pat. No. 4,578,141, the complicated movements needed to lay the filaments on the hooks on the moving chains, and the subsequent movement of the chains to pull the filaments to the full width of the fabric may create entanglement and limit both the speed of the machine and the uniformity of the resulting fabric. Some chain machines, such as shown in U.S. Pat. No. 3,345,231, are capable of high lineal output of fabric, but their crosswise filaments are not self-supporting and cannot produce a fabric with lengthwise filaments perpendicular to crosswise filaments.

SUMMARY OF THE INVENTION

In the process of this invention a plurality of filaments are laid in engageable relationship with two sets of edge spacing pins, which determine the distance between crosswise filaments for each edge of the fabric to be made. A portion of the filaments is also laid in engageable relationship with a set of slider pins which are traversable. The edge spacing pins and the slider pins are engaged with the filaments, and the filaments are gripped adjacent one set of edge spacing pins. The slider pins are then moved to pull the filaments to a length between the edge spacing pins which is substantially equal to the width of the fabric. A portion of the filaments adjacent one set of edge spacing pins is attached to a first edge element, and a portion of the filaments adjacent the other set of edge spacing pins is attached to a second edge element. The filaments are severed from their source, the edge spacing pins and the slider pins are disengaged from the filaments, and the edge elements are separated, drawing the crosswise filaments to the width of the fabric.

"Filaments" as used herein comprises threads, yarns, tapes, ribbons and the like. "Pins" as used herein, includes hooks, needles, mechanical gripping mechanisms and the like. While the edge spacing pins may be movable for distances which are short relative to the width of the fabric or the movement of the slider pins, they do not traverse such large distances.

In preferred embodiments of the invention, the filaments are supported after they are disengaged from the slider at least until the edge elements begin to separate; the filaments are placed in engageable relationship with the pins by means of hollow tubes, each tube carrying a filament within it; or the edge elements comprise belts and selvage filaments which are removed from the belts after the crosswise filaments are adhered to the selvage filaments. We also prefer to make one or both sets of edge spacing pins capable of a short movement after the slider pins have pulled the filaments to substantially their full length; this movement serves to remove any slack from the crosswise filaments and make them all of uniform length. A dancer roll apparatus may preferably be used at the output of the machine to take up intermittent feed from the process or to provide feedback to one or both edge elements to adjust their relative speed.

The invention also comprises machines which embody the above described processes, crosswise filaments made by those processes, and fabrics incorporating crosswise filaments made by those processes.

The present invention is much simpler than prior art devices and therefore not only less expensive to build but also capable of achieving more uniform fabrics and higher production rates. Speeds are expected of 100 lineal feet or more of fabric per minute. In fact, for any specific machine of this invention, the rate of lineal production is independent of the number of crosswise filaments. In the prior art with machines such as the rotary arm machines, as mentioned above, if one wanted to double the number of crosswise filaments per inch, one had to halve the production rate.

The simplicity of the invention follows from its feature of requiring only one major part to traverse a substantial distance. The other major movements are both short and uncomplicated, being for the most part simple back and forth movements. High speed inter-meshing of rotating arms, moving chains with hooks, and toothed wheels, all guided by cams with complexly curved surfaces, are not necessary in the present invention.

A high degree of uniformity in the resulting products can also be achieved with the present invention more easily then could be achieved in the prior art, if such uniformity could be achieved at all. Because the edge spacing pins of the present machine are (a) rigidly fixed relative to each other as a group, and (b) do not traverse substantial distances, such as occurs in machines which use moving chains, one is able to produce more uniformly spaced crosswise filaments than could readily be done in the prior art. In addition, as will be seen in the description below, with the present invention one is able (a) to achieve better uniform length for the crosswise filaments, (b) to adhere the filaments to selvage filaments and thereby preserve that uniform length, and (c) by the use of feedback, to control of the edge elements precisely.

The present invention also requires less wastage of filaments than prior art machines and processes.

These and additional features to be described below make the present inventions a significant advance over the prior art.

BRIEF DESCRIPTION OF THE DRAWINGS

The drawings are not to scale. For clarity, only the first five and last five pins, tubes and filaments in each row are shown; repetitive pins, tubes and filaments interposed at regular intervals have been omitted.

FIG. 6 is a top view of the machine of FIG. 1 at the step shown in FIG. 5.

DESCRIPTION OF PREFERRED EMBODIMENTS

Figure 1:
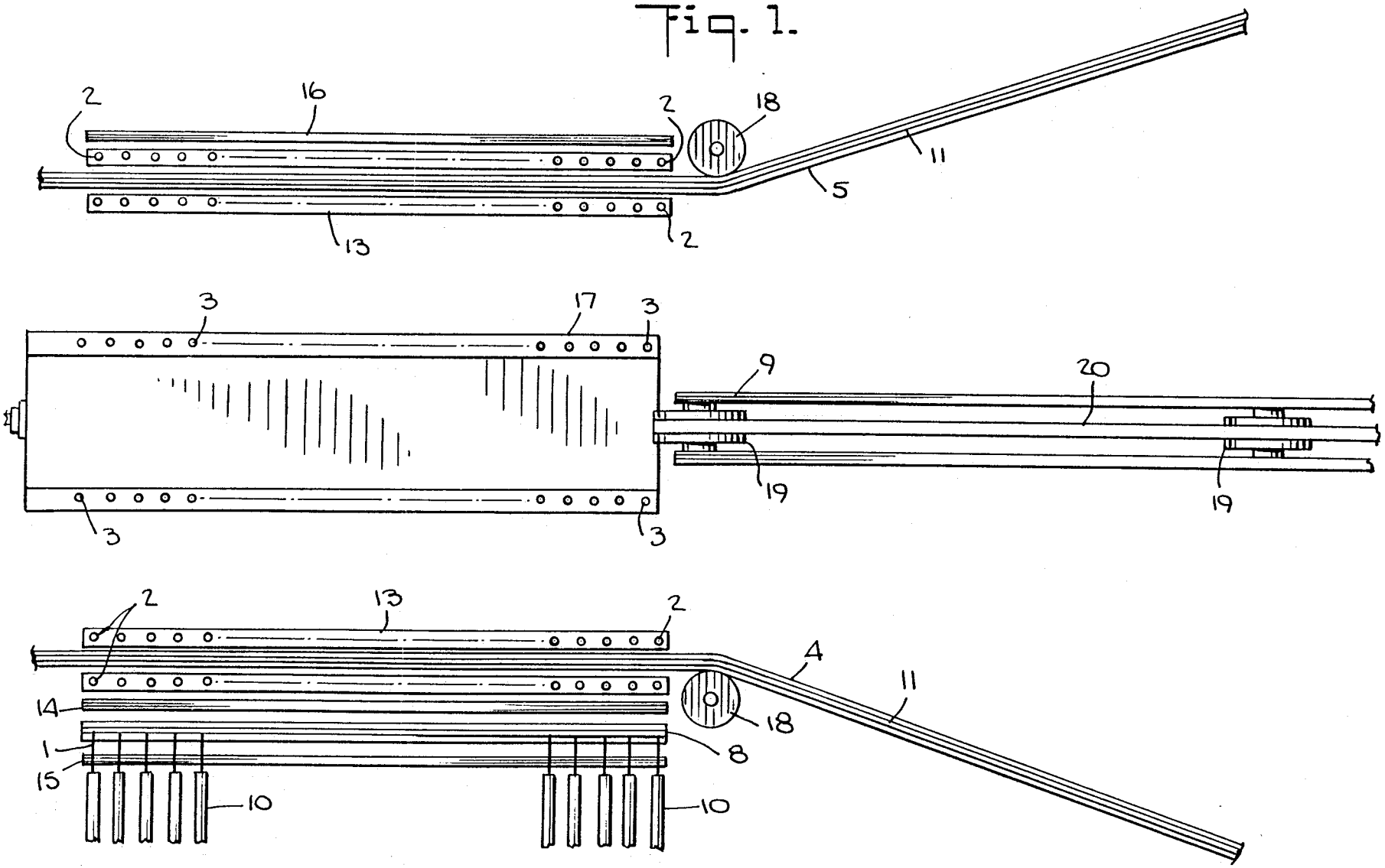
FIG. 1 is a top view of a preferred embodiment of the invention at the beginning of the process.

A preferred embodiment of the present invention, as shown in FIG. 1, comprises filaments 1, which are led through hollow tubes 10; edge spacing pins 2, held on supports 13; slider pins 3, held on a slider 17; a first edge element timing belt 4, and a second edge element timing belt 5, and edge element selvage filaments 11, held by edge element pulleys 18; grippers 14, 15 and 16; a cutter 8; a fuzz belt 20 to support filaments after disengagement from the slider pins, which belt is supported by fuzz belt pulleys 19, held by support 9. While only the first five and last five filaments 1, tubes 10, and pins 2 and 3 are shown, the pin holders 13 and slider 17 could be made forty-eight inches (121.92 cms.) long, each with ninety-six pairs of pins, one pair every half inch (1.27 cms.). The pins, preferably made from a tough but not brittle material, for example 4–40 stainless steel heat-treated to 45–50 hardness on the Rockwell Test C scale, may have a height of about one quarter inch (0.6350 cm.). (These and other materials and dimensions set forth in this specification are only those of preferred embodiments and do not limit the scope of the invention.) The fuzz belt may be made of fabric, one half inch (1.27 cms) wide with a one quarter inch (0.635 cm.) pile. The tubes 10 are preferably seamless, six inches (15.24 cms.) long, and have an outside diameter of three sixteenths of an inch (0.48 cm) and an inside diameter of three-thirty-seconds of an inch (0.238 cm.). The slider 17 may be about 2 inches (5.08 cms.) wide.

As an example of the simplicity and flexibility of the present invention, the pins 2 and 3 can be made part of removable top pieces for holders 13 and slider 17. If one wishes to change the number of crosswise filaments per inch (2.54 cms.), one need only change to a holder having the desired number of pins per inch (2.54 cms.) and change the number hollow tubes. The other elements of the machine need not be changed. Moreover, as will be made clear hereinafter, changing the number of pins and hence the number of crosswise threads in this manner does not change the lineal rate of production of fabric made using this machine.

Figure 2:
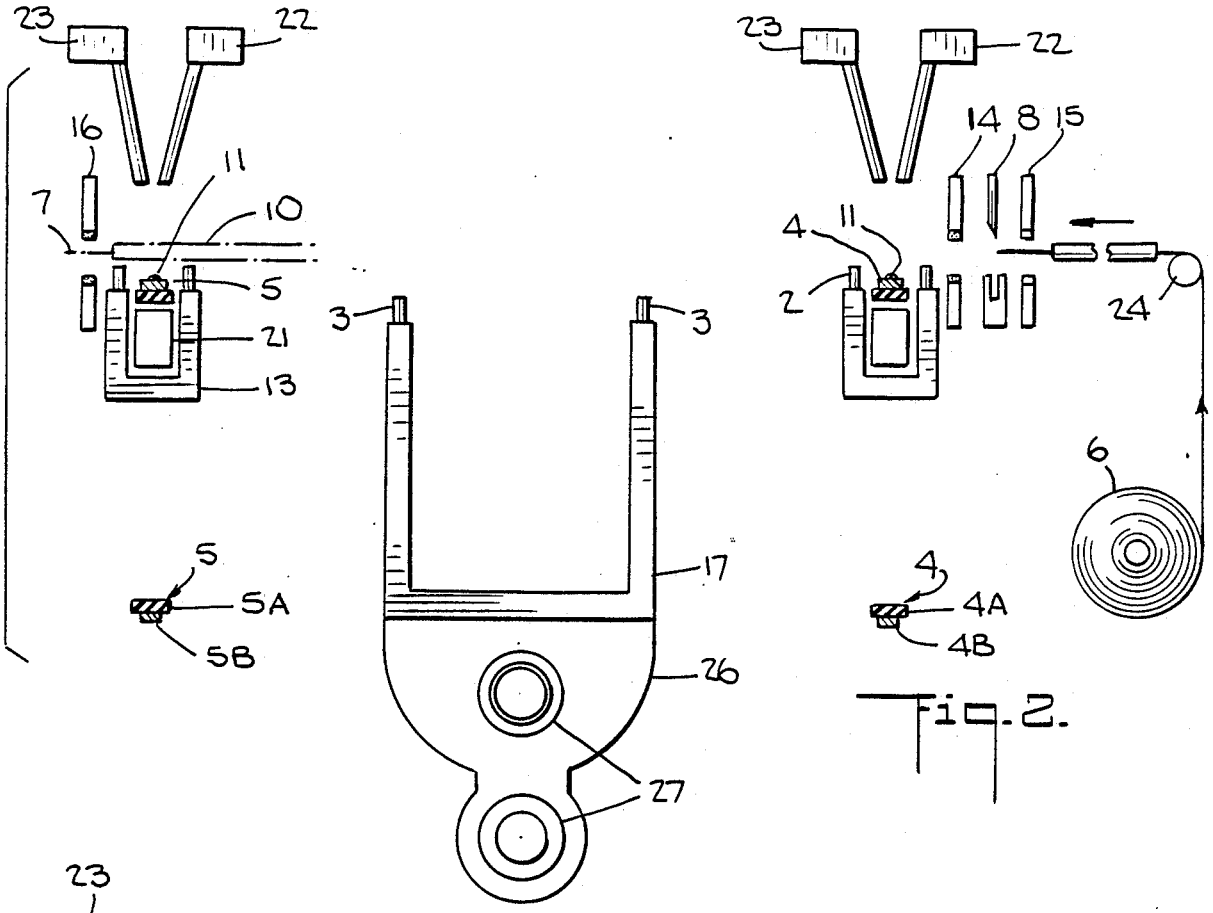
FIG. 2 is a cross section of the machine of FIG. 1 showing the placing of filaments.

FIG. 2 shows the pin holders 13 and slider 17 in their lowered positions so they do not interfere with the tubes 10 as they move from left to right, placing the end 7 of filament 1 through the one-half inch (1.27 cms.) opening of gripper 16. The slider 17 is held by its support 26, which is traversable on rods 27. The filament 1 is led from filament source 6, which may be a creel or bobbin, around pulley 24. Its end 7 protrudes about one half inch (1.27 cms.) beyond the tube 10. FIG. 2 also shows rigid anvil supports 21 for the edge elements, which in this embodiment are comprised of the selvages 11 and first and second endless timing belts 4 and 5. The endless timing belts 4 and 5 are shown in cross section, both as they travel in the direction of manufacture and on their return. They are preferably made of supporting material 4A and 5A, such as a rubber belt or a stainless steel band, with a silicone rubber upper material 4B and 5B, which will not adhere permanently to adhesives that may be used on selvage filaments 11 to adhere crosswise filaments. Preferably the adhesives used on filaments provide some tackiness with respect to the silicone rubber, but are readily and completely strippable from it. Selvage filaments 11 are shown above crosswise filaments 1, but they could be led below filaments 1, or two selvage filaments could be used on each side of the machine, one selvage filament above and one below crosswise filaments 1.

Figure 3:
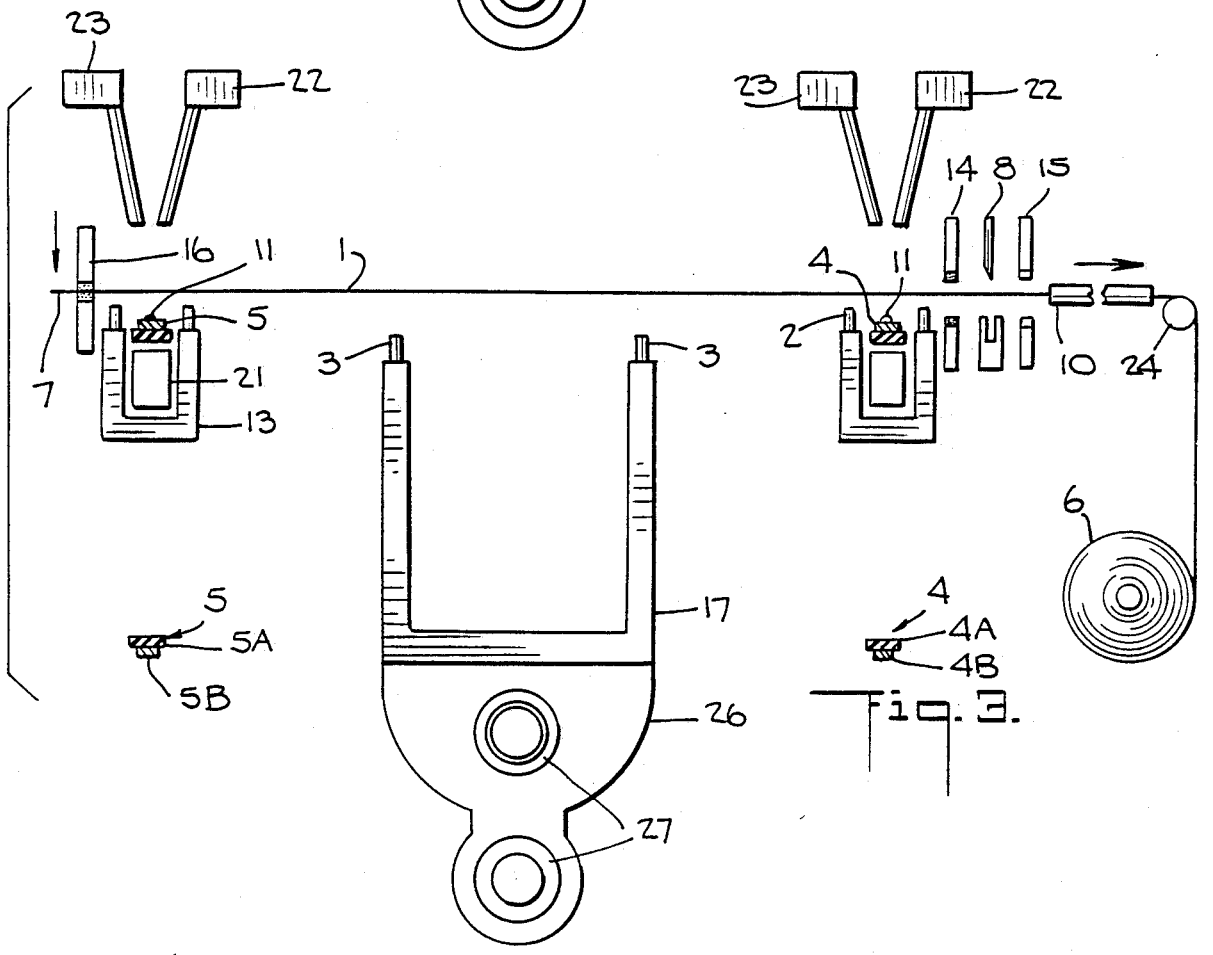
FIG. 3 is a cross section of the machine of FIG. 1 after filaments have been placed.

FIG. 3 shows the filament end 7 gripped by gripper 16 and the hollow tubes 10 retracted to their original position.

Figure 4:
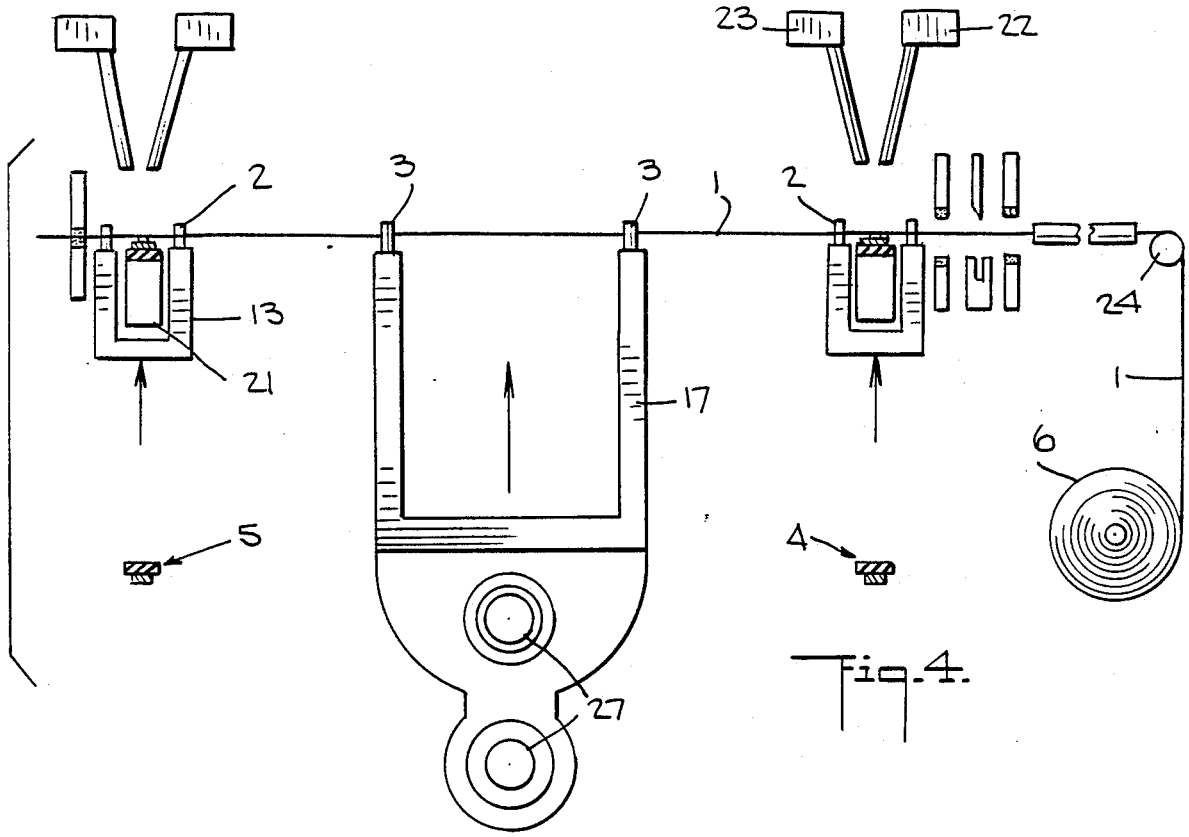
FIG. 4 is a cross section of the machine of FIG. 1 after pins have been engaged with filaments.
Figure 5:
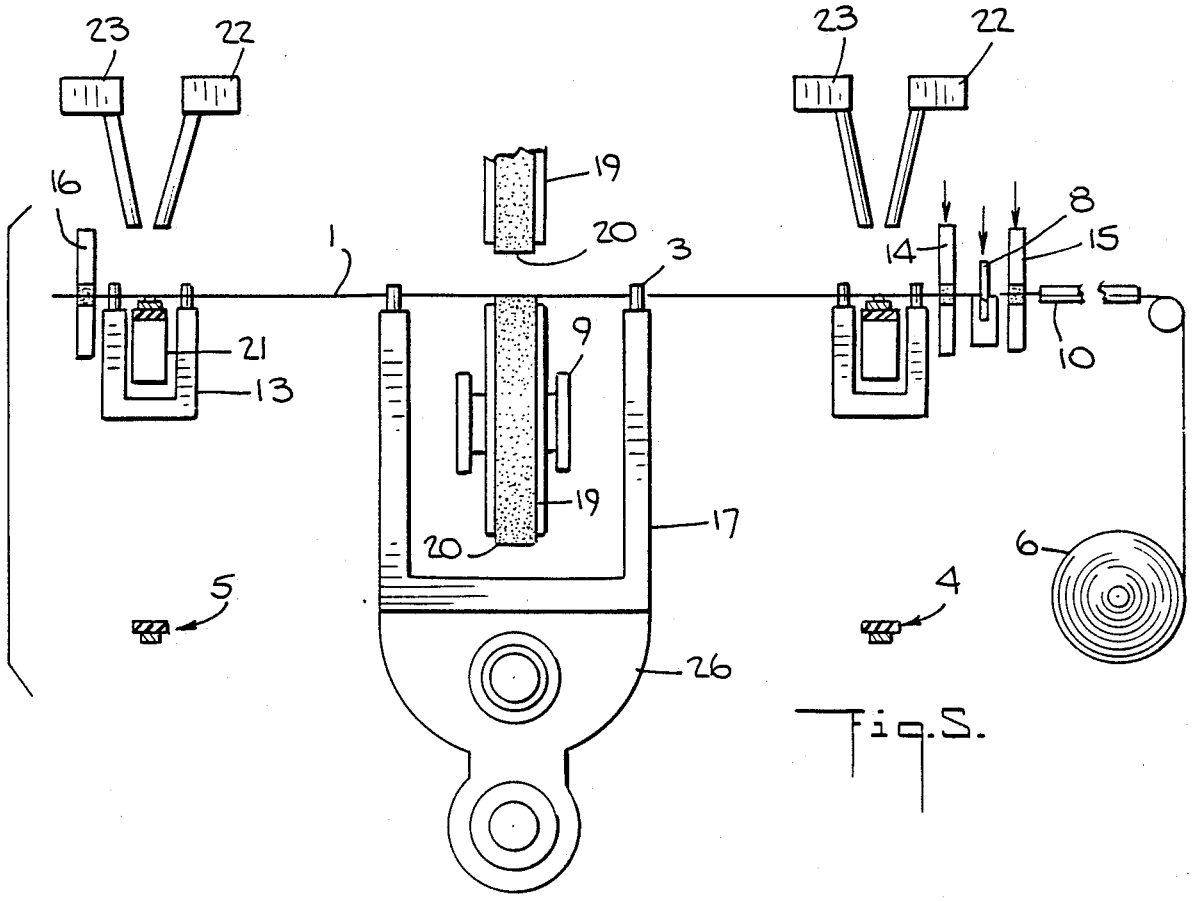
FIG. 5 is a cross section of the machine of FIG. 1 after the filaments have been pulled to their full length and cut.
Figure 5:
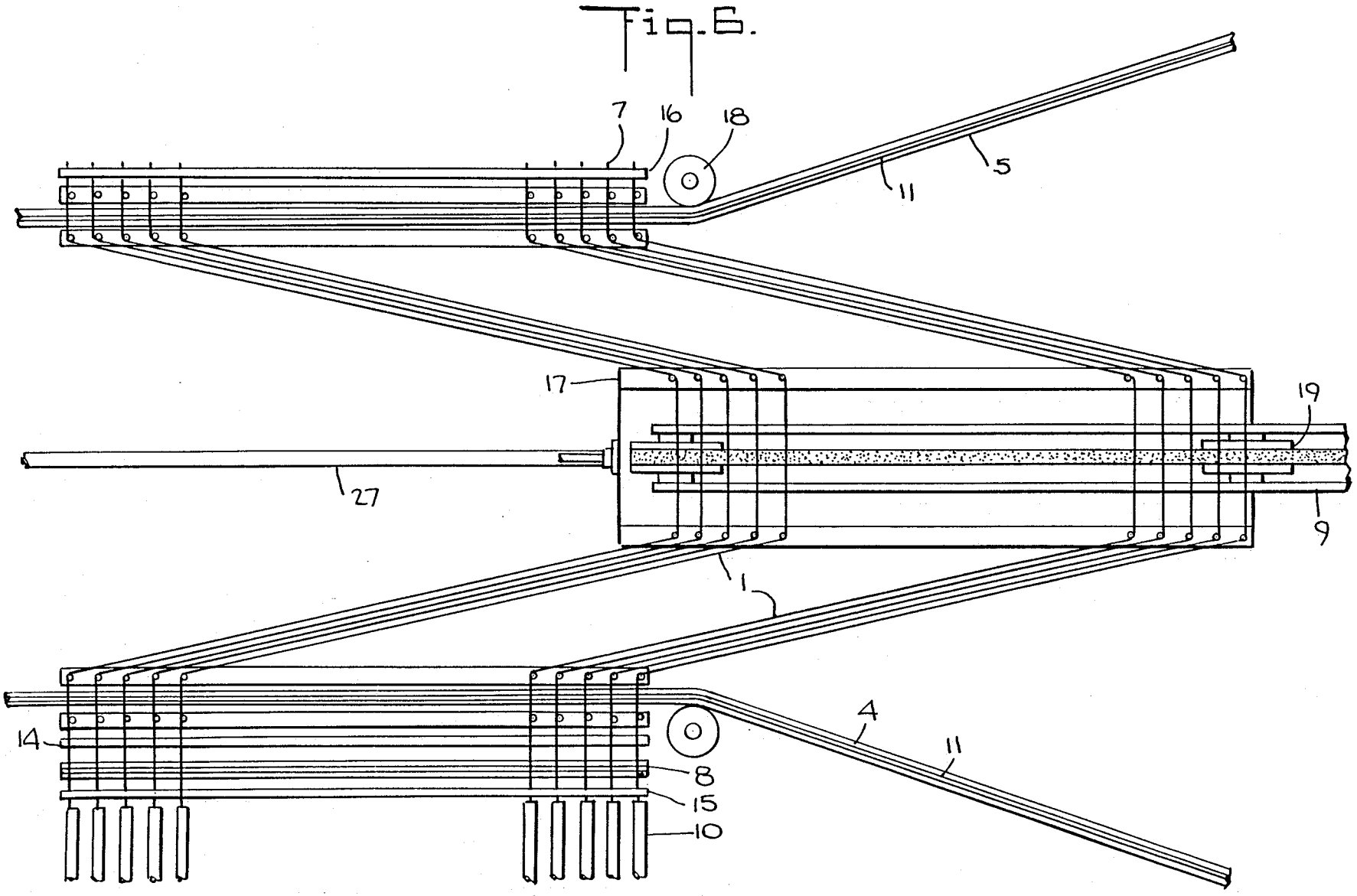

In FIG. 4 the slider 17, with its support 26 and rods 27, and pin holders 13 have been raised so that their pins 2 and 3 engage the filament 1 by moving the pins into the plane of the filament. This movement up and down need be only about one-quarter inch (0.635 cm.). The slider 17 is then traversed on its rods 27 to the position shown in FIG. 6. This pulls the filaments 1 from the source 6 to a length substantially equal to the width of the fabric ultimately to be produced. Alternately, two sliders could be used with a row of non-traversing pins between then, thus cutting the travel distance of the sliders approximately in half. As shown in FIG. 5, when the filaments have been pulled, the grippers 14 and 15 close.

In one preferred embodiment, the filaments 1 are not cut immediately. Instead, the grippers 14 and 15 engage the filaments 1 only frictionally, permitting the filaments to be pulled through the grippers 14 and 15 if moderate tension is applied, while the gripper 16 holds the filaments more securely and does not permit such slippage. In this preferred embodiment the gripper 16 or the pin holder 13 adjacent the filament ends 7 then moves a distance which is short relative to the width of the fabric, for example one-half inch (1.27 cms.), to remove any slack that may be present in the filaments 1. If there is slack in one or more filaments, it is removed. If there is no slack in one or more filaments, the movement will pull such filaments through the frictionally engaged grippers 14 and 15.

When the filaments 1 are at the desired uniform length, the cutter 8 operates to cut them, as shown in FIG. 5. While the cutter 8 is shown as a knife, it could be a hot wire if the filaments are of an appropriate material, such as a thermoplastic.

Figure 7:
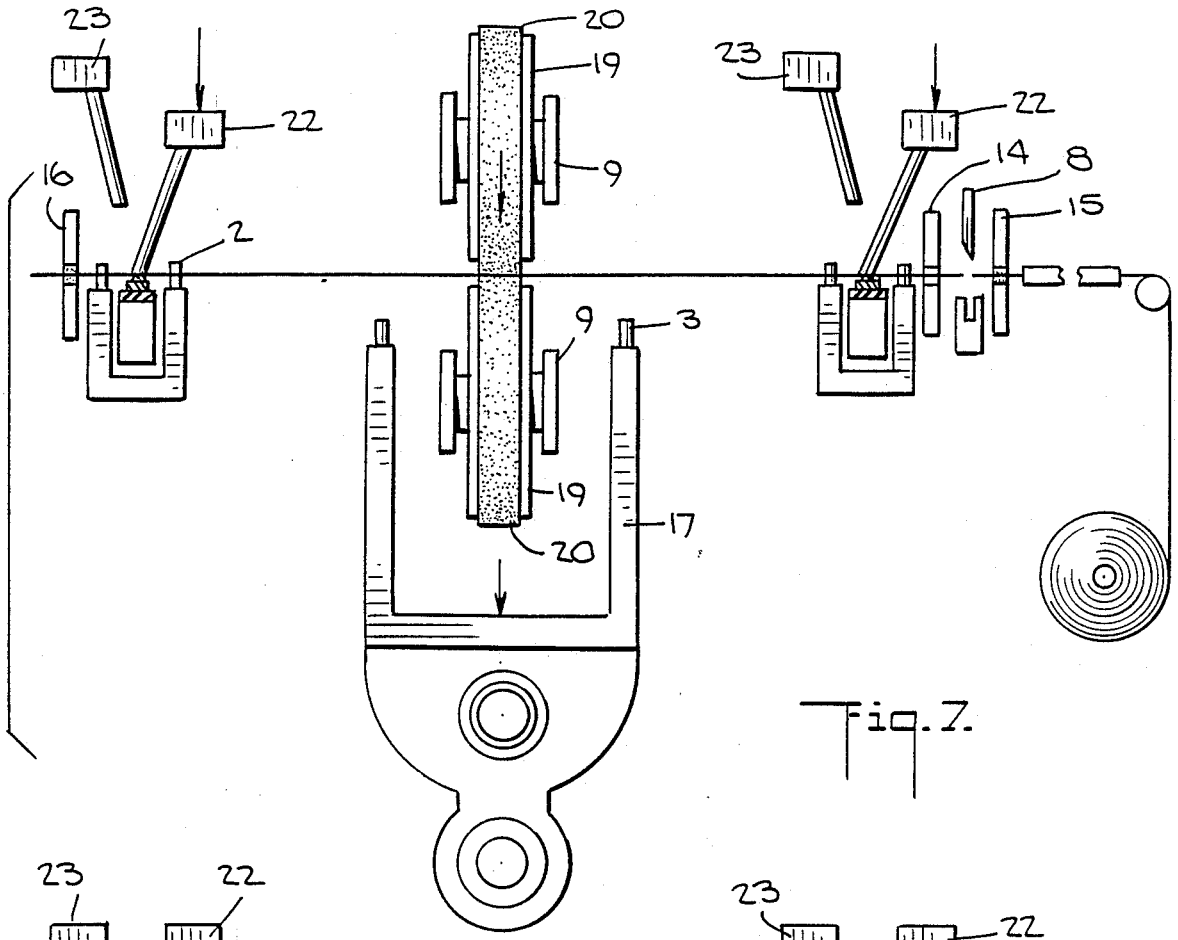
FIG. 7 is a cross section of the machine of FIG. 1 showing affixing of selvage filaments to crosswise filaments.

As shown in FIG. 7, the slider pins 3 are disengaged from the crosswise filaments by lowering slider 17 about one-quarter inch (0.635 cm.) from the plane of the filaments. The fuzz belts 20, which are held by pulleys 19 and pulley support 9, engage the filaments. In this embodiment, the upper fuzz belt 20 lowers to gently pinch and hold the filaments 1 between the two belts. Alternatively, the lower fuzz belt could rise to remove filaments from slider pins 3.

Also as shown in FIG. 7, in this embodiment a heater bar 22, optionally used with a teflon surface supported by an endless fiber glass belt interposed between the bar 22 and the selvage filaments 11 to reduce any accumulation of adhesive, lowers to apply heat and pressure to the crosswise filaments 1 and the selvage filaments 11. The heat activates a heat activatable adhesive coating on selvage filaments 11 in this preferred embodiment. Preferred heat activatable adhesives are high melt, fast set adhesives such as those made from ethylene copolymers. A suitable adhesive is adhesive No. 9224-2, Uparco Adhesives, Nashua, N.H. Pressure sensitive adhesives and other sealing materials, such as water based adhesives and certain vinyls which can be activated by dielectric induction heating, may also be used. Alternatively, with certain kinds of filaments dielectric induction heating or ultrasonics may melt the filaments themselves and make them self-gluing.

It is also contemplated that the crosswise filaments 1 may be detachably attached to the edge filaments. For example, crosswise filaments 1 may be held by mechanical means, such as a rubber belt with a groove in it and a wire which fits snugly into the groove, pinching the filaments 1 to the edge elements until lengthwise filaments and a coating are applied, at which time one may separate the wire and belt and thereby release the filaments.

In the embodiment shown in the figures, after removal of the heating bar, cooling air from a pneumatic source located in structure 23 fixes the heat activatable adhesive, firmly affixing the crosswise filaments 1 to the selvage filaments 11. Alternatively, structure 23 may be a cooling bar which lowers and presses against the filaments and sets the adhesive. As a further alternative, structure 23 may provide a mist to accomplish the same purpose.

Because the step of adhering crosswise filaments to selvage filaments may be the speed limiting factor in the operation of the machine, two spring mounted bars or other means may be mounted on either side of the heating bar to hold the crosswise filaments. In such an embodiment the additional bars are arranged to press and hold the crosswise filaments tightly against the selvage filaments and to continue to hold the crosswise filaments in place for a brief period after removal of the heating bar. During that period, a blast of cold air or mist may be applied without disturbing the location of the crosswise filaments, thus quickly setting the adhesive and fixing the crosswise filaments to the selvage filaments. These additional bars may be, for example, 1/16 inch (0.0625 cm.) wide and spaced on either side of a heating bar and 1/16 inch (0.0625 cm.) from it.

Figure 8:
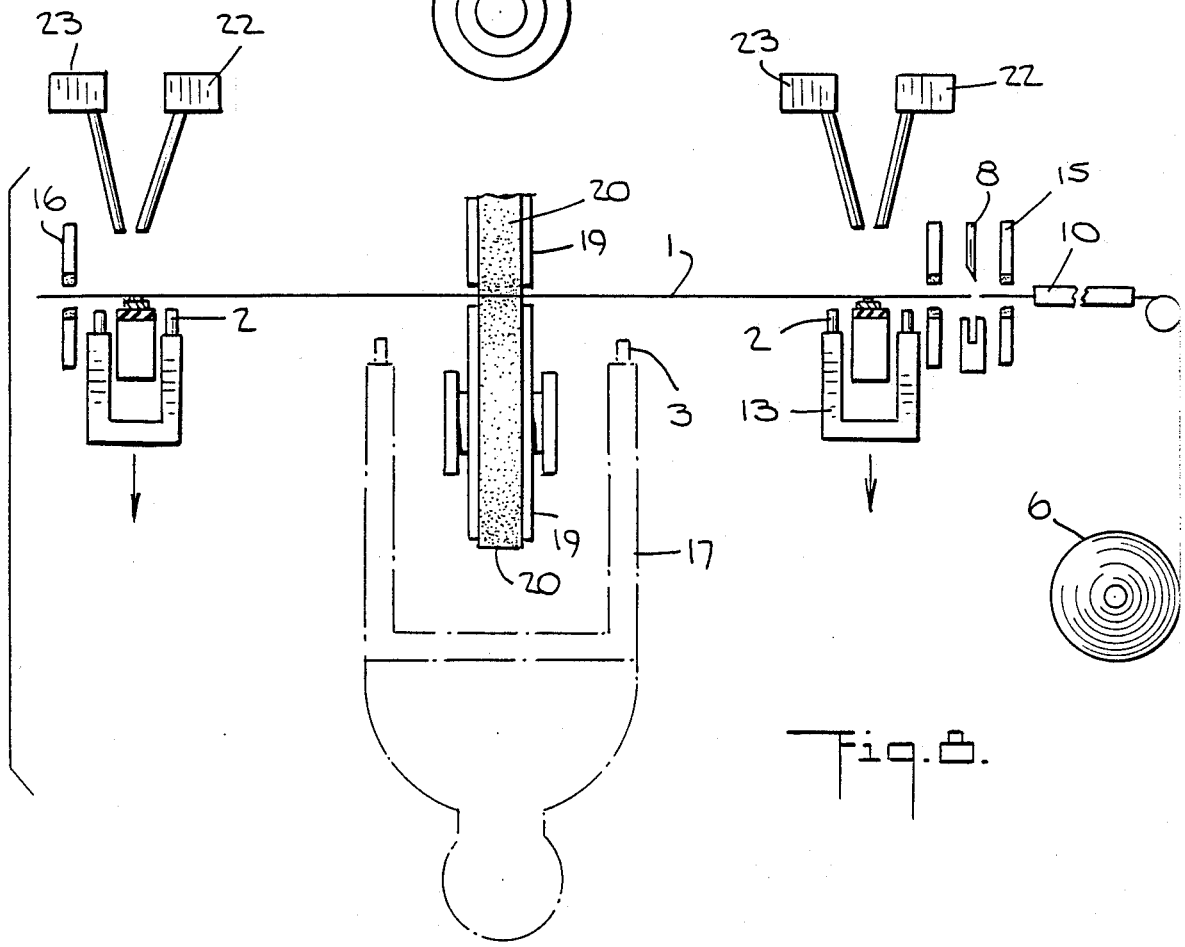
FIG. 8 is a cross section of the machine of FIG. 1 upon disengagement of the edge spacing pins.

The edge spacing pins 2 are disengaged from the filaments 1, in this example by lowering supports 13 about one-quarter inch (0.635 cm.), as shown in FIG. 8. The edge elements 4, 5 and 11 and the fuzz belts 20 thereafter move forward the full length of the rows of the edge spacing pins, in this example four feet, and the process of laying the crosswise filaments begins again. If selvage filaments 11 are used, they may be removed from the timing belt just after the belt leaves the area of the edge spacing pins, or alternatively the timing belt and the selvage may be kept together, as shown in these figures, for part or all of the distance during which the crosswise filaments are spread apart.

Figures 9, 10, 11, 12:
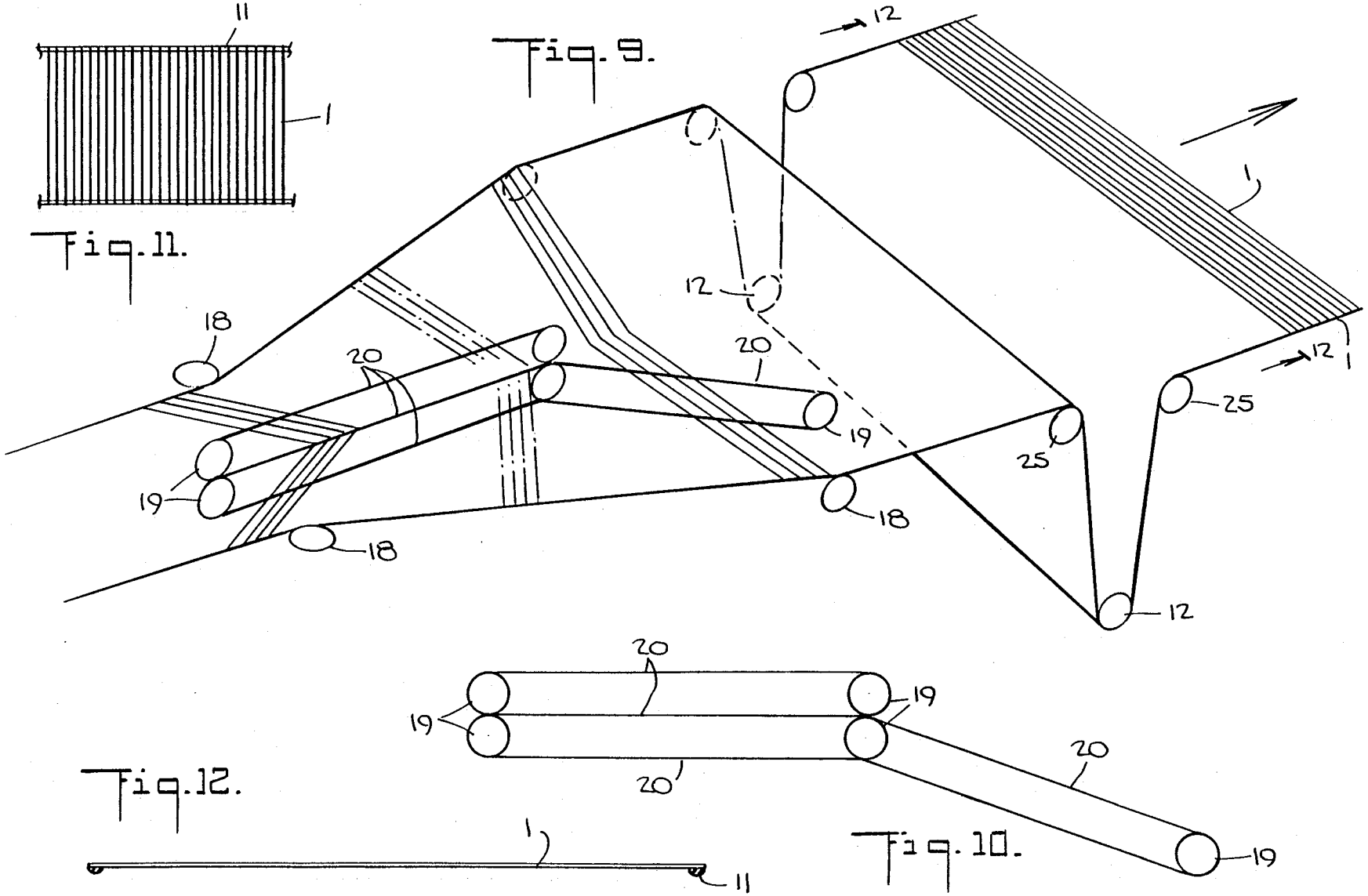
FIG. 9 is a three-quarter view drawing of the process as crosswise filaments are spread to the width of the fabric.
FIG. 10 is a side view of apparatus for supporting crosswise filaments after disengagement from the pins.
FIG. 11 is a top view of self supporting crosswise filaments of the invention.
FIG. 12 is an end view of the filaments of FIG. 11.

Referring to FIG. 9, as the crosswise filaments 1 leave the area where they are laid, they are in the form of a sharp "V". As the edges spread apart, the "V" becomes less sharp. The fuzz belt is made of pile fabric in order to hold the crosswise filaments and prevent entangling. As the belt proceeds, the final portion of it declines, as shown in FIG. 10, to disengage it from the crosswise filaments, which are simultaneously rising as a result of the edge elements being led apart. Pulleys 18 guide the edge elements. Rolls 25 carry the crosswise filaments. Because this machine has an intermittent operation—in this example pulsing in four foot increments—a dancer roll 12 may be usefully employed to eliminate the pulsation at the output. Such a dancer roll 12 and selvage filaments 11 permit the crosswise filaments of this invention to be fed directly to coaters, which could not be done with some prior art machines and processes.

A dancer roll 12 also permits incorporation of a preferred feed back control. If the distance each end of the dancer roll 12 travels is measured at each operation pulse, and a difference in displacement of its two ends is noted, that difference can be used to adjust the travel of timing belt 4 or 5 on the next pulse. For example, the timing belts may be operated by two hydraulic pistons, each having precise travel distances. Each piston is arranged to grasp and push a portion of each belt. The travel of each piston may be precisely controlled by stops which halt the piston's movement after an appropriate distance. One of these stops may be made movable in increments of 0.010 (ten thousandths) of an inch (0.0254 cm.) in response to a signal from the dancer roll 12. Every time a difference in travel distance between the two ends of the dancer roll is detected, indicating that one edge is longer than the other, the feedback control signals the stop to move one increment in the appropriate direction to reduce the difference. Such a self-compensation arrangement is more practical and satisfactory than attempting to make both timing belts move in exact precision, and could not be done with chain and hook mechanisms of the prior art.

FIG. 11 shows a top view of self-supporting crosswise filaments made by the machine and process of FIGS. 1 to 10, and FIG. 12 shows an end view of such filaments.

The above describes only one embodiment and some preferred variations of the present invention. Its simplicity, its capabilities and the other disclosures above will no doubt suggest equivalents and various rearrangements and combinations of steps to others skilled in the art, all of which are intended to be covered by the following claims.

I claim:

1. A process of forming crosswise filaments for non-woven fabric having a width comprising the steps of,
   - placing a plurality of filaments in engageable relationship with two sets of substantially non-traversing edge spacing pins and a set of traversable slider pins,
   - gripping the filaments adjacent a set of edge spacing pins,
   - engaging the filaments with the edge spacing pins and the slider pins,
   - moving the slider pins to pull the filaments to a length between the edge spacing pins substantially equal to the width of the fabric,
   - attaching a portion of the filaments adjacent one set of edge spacing pins to a first edge element,
   - attaching a portion of the filaments adjacent the other set of edge spacing pins to a second edge element,
   - cutting the filaments adjacent the edge spacing pins to separate them from a source thereof,
   - disengaging the edge spacing pins and the slider pins from the filaments, and
   - separating the edge elements to the width of the fabric.

2. The process of claim 1 which comprises supporting filaments from the time they are disengaged from the slider pins at least until the edge elements for those filaments begin to separate.

3. The process of claim 1 in which filaments are placed in engageable relationship by means of traversing hollow tubes which carry filaments within the tubes.

4. The process of claim 1 in which the slider pins are located between the edge spacing pins.

5. The process of claim 1 in which the filaments are placed in engageable relationship with the edge spacing pins and the slider pins simultaneously.

6. The process of claim 1 in which the edge spacing pins are engaged with the filaments by moving the pins into the plane of the filaments.

7. The process of claim 1 in which the slider pins are engaged with the filaments by moving the pins into the plane of the filaments.

8. The process of claim 1 in which the slider pins comprise two parallel sets of pins, each set comprising one pin for each filament.

9. The process of claim 1 in which the slider pins are moved in a plane parallel to the plane of the two sets of edge spacing pins.

10. The process of claim 1 in which, after the slider pins have pulled the filaments to a length substantially equal to the width of the fabric, at least one set of edge spacing pins, in conjunction with grippers which grip the filaments, remove any slack from the filaments and create filaments of uniform length.

11. The process of claim 1 which includes the additional step of detaching the edge elements from crosswise filaments.

12. The process of claim 1 in which the edge elements comprise selvage filaments.

13. The process of claim 12 in which the selvage filaments comprise an adhesive which causes the crosswise filaments to adhere to the selvage filaments.

14. The process of claim 13 in which the adhesive is heat activatable.

15. The process of claim 13 in which the adhesive is pressure sensitive.

16. The process of claim 1 in which the edge elements comprise endless timing belts.

17. The process of claim 1 which comprises feeding back from a dancer roll apparatus at the output of the machine signals to adjust the speed of at least one edge element.

18. The process of claim 10 in which the filaments are thereafter permanently affixed to the edge elements, whereby the uniform length of the filaments between the edge elements is preserved.

19. The process of claim 17 in which the dancer roll apparatus detects whether one edge element is proceeding at a greater rate than the other edge element and the process comprises using that detected information to control the feed rate of the edge elements and correct any imbalance in the feed rates.

20. A machine for forming crosswise filaments for non-woven fabric having a width comprising,
   - two sets of substantially non-traversing edge spacing pins,
   - a set of traversable slider pins located between the two sets of edge spacing pins,
   - means for placing a plurality of filaments in engageable relationship with said edge spacing pins and said slider pins,
   - grippers for gripping the filaments adjacent one set of edge spacing pins,
   - means for engaging the edge spacing pins and the filaments,
   - means for engaging the slider pins and the filaments,
   - means for disengaging the edge spacing pins and the filaments,
   - means for disengaging the slider pins and the filaments,
   - means causing the slider pins to pull the filaments to a length between the two sets of edge spacing pins substantially equal to the width of the fabric,
   - means for attaching a portion of the filaments adjacent one set of edge spacing pins to a first edge element,
   - means for attaching a portion of the filaments adjacent the other set of edge spacing pins to a second edge element,
   - a filament cutter located adjacent one set of edge spacing pins, and
   - means to separate the edge elements to the width of the fabric.

21. The machine of claim 20 which comprises means to carry the filaments after they are disengaged from the slider pins and before the edge elements have begun to separate.

22. The machine of claim 21 in which the means to carry the filaments comprises an endless belt of pile fabric.

23. The machine of claim 20 in which the means for placing the plurality of filaments comprises traversing hollow tubes.

24. The machine of claim 20 in which both means for attaching a portion of the filaments to the edge elements comprises means to permanently affix said filaments to said edge elements whereby a self-supporting fabric is created.

25. The machine of claim 20 in which the means for engaging the edge spacing pins with the filaments comprises means to move the edge spacing pins into the plane of the filaments.

26. The machine of claim 20 in which the means for engaging slider pins with the filaments comprises means to move the slider spacing pins into the plane of the filaments.

27. The machine of claim 20 in which the slider spacing pins comprise two parallel sets of pins, each set comprising one pin for each filament.

28. The machine of claim 20 which comprises means to place the filaments in engageable relationship with the edge spacing pins and the slider pins simultaneously.

29. The machine of claim 20 which comprises means to pull the filaments in a plane parallel to the plane of the two sets of edge spacing pins.

30. The machine of claim 20 which comprises means to remove slack and create uniform length in the filaments before they are affixed to the edge elements.

31. The machine of claim 20 which comprises a heater bar for heat sealing crosswise filaments to an edge element.

32. The machine of claim 20 in which the filament cutter comprises a heated element.

33. The machine of claim 20 which comprises dancer roll apparatus to absorb intermittent production of crosswise filaments and provide a supply of such filaments at a uniform rate.

34. The machine of claim 33, which comprises feedback means from the dancer roll apparatus to at least one edge element to adjust the speed of the edge element.

35. The machine of claim 34 in which the dancer roll apparatus comprises means to detect whether one edge element is proceeding at a greater rate than the other edge element and means to feed that information back to apparatus which controls feeding the edge elements to correct the imbalance in feed rate.

36. The machine of claim 24 which includes means to provide stand-alone capability comprising means to convey said self-supporting fabric directly to a succeeding machine for further processing.

37. The machine of claim 20 which includes means for detaching crosswise filaments from the edge elements.

* * * * *

UNITED STATES PATENT AND TRADEMARK OFFICE

CERTIFICATE OF CORRECTION

PATENT NO. : 4,867,825

DATED : September 19, 1989

INVENTOR(S) : LESTER GIDGE

It is certified that error appears in the above-identified patent and that said Letters Patent is hereby corrected as shown below:

AT [57] ABSTRACT

Line 9, "including" should read --include--.

COLUMN 7

Line 67, "the" should be deleted.

COLUMN 8

Line 8, "at the output of the" should be deleted.
Line 9, "machine" should be deleted.

Signed and Sealed this

Twenty-sixth Day of February, 1991

*Attest:*

HARRY F. MANBECK, JR.

*Attesting Officer*

*Commissioner of Patents and Trademarks*